US007424843B2

(12) United States Patent
Guillory

(10) Patent No.: US 7,424,843 B2
(45) Date of Patent: Sep. 16, 2008

(54) WRAPPING PAPER STORAGE DEVICE AND DISPENSER

(76) Inventor: Samuel L. Guillory, 1103 Park Ave., New York, NY (US) 10128

( * ) Notice: Subject to any disclaimer, the term of this patent is extended or adjusted under 35 U.S.C. 154(b) by 0 days.

(21) Appl. No.: 11/586,933

(22) Filed: Oct. 26, 2006

(65) Prior Publication Data

US 2008/0098868 A1 May 1, 2008

(51) Int. Cl.
*B26D 5/00* (2006.01)

(52) U.S. Cl. ..... 83/614; 83/648; 83/649; 225/39; 225/56; 225/90

(58) Field of Classification Search ..... 83/614, 83/56, 649, 445, 648; 225/56, 91, 47, 53, 225/77, 90, 39
See application file for complete search history.

(56) References Cited

U.S. PATENT DOCUMENTS

| | | | | |
|---|---|---|---|---|
| 3,142,217 | A | 7/1964 | Busse | 83/375 |
| 3,142,426 | A | 7/1964 | Busse | 225/43 |
| 3,739,964 | A | 6/1973 | Stine | 225/47 |
| 4,156,382 | A * | 5/1979 | Baker | 493/86 |
| 4,238,065 | A | 12/1980 | Ragsdale | 225/47 |
| 4,607,774 | A | 8/1986 | Garr | 225/47 |
| 4,787,284 | A | 11/1988 | Chen | 83/614 |
| 4,796,792 | A | 1/1989 | Nelson et al. | 225/72 |
| 4,858,807 | A | 8/1989 | Cvek | 225/58 |
| 4,957,023 | A | 9/1990 | Chen | 83/372 |
| 5,011,059 | A | 4/1991 | Jennings, Jr. et al. | 225/35 |
| 5,025,692 | A * | 6/1991 | Reynolds | 83/468 |
| 5,044,241 | A | 9/1991 | Labrecque | 83/489 |
| 5,301,854 | A | 4/1994 | Scobey | 225/34 |
| 5,611,255 | A | 3/1997 | Evans | 83/614 |
| 5,802,942 | A * | 9/1998 | Cornell et al. | 83/455 |
| 6,223,639 | B1 * | 5/2001 | Chen | 83/614 |
| 7,000,520 | B2 | 2/2006 | Nichols et al. | 83/578 |
| 2003/0209122 | A1 | 11/2003 | Nguyen | 83/614 |
| 2004/0007606 | A1 | 1/2004 | Baker, Jr. | 225/1 |
| 2004/0011168 | A1 | 1/2004 | Sears, Jr | 83/13 |

(Continued)

OTHER PUBLICATIONS http://www.bobthejanitor.com/rey914sc.html, "Reynolds Slide Cutter Film".

(Continued)

*Primary Examiner*—Boyer D. Ashley
*Assistant Examiner*—Omar Flores-Sánchez
(74) *Attorney, Agent, or Firm*—Ernest D. Buff & Associates LLC; Ernest D. Buff

(57) ABSTRACT

A wrapping paper storage device and dispenser supports a sheet of wrapping paper between the top wall of the dispenser and a flap member. This support continues throughout the cutting operation, so that curling, wrinkling or edge deformation of the wrapping paper is prevented. The flap member is provided with a flap slot in a hard polymeric sheet. An upper surface of the top wall of the dispenser is comprised of a hard flat polymeric sheet. The cutter traverses the flap slot when contacting the hard flat polymeric sheet, thereby severing the fully supported wrapping paper in a reliable, efficient manner. The cutter may be a separate cutting implement, such as a razor blade or knife. It may alternatively comprise an integral, spring loaded, slidable cutter that rides in the flap slot.

11 Claims, 4 Drawing Sheets

U.S. PATENT DOCUMENTS

| | | | | |
|---|---|---|---|---|
| 2004/0216574 | A1 | 11/2004 | Chabansky | 83/574 |
| 2005/0005755 | A1 | 1/2005 | Turvey et al. | 83/614 |
| 2005/0072826 | A1 | 4/2005 | Sewell et al. | 225/49 |
| 2006/0021485 | A1 | 2/2006 | Richards | 83/425.4 |

OTHER PUBLICATIONS http://www.nu-era.com/wrap-dispensers.asp, "Gift Packaging Dispensers".

* cited by examiner

WRAPPING PAPER STORAGE DEVICE AND DISPENSER

BACKGROUND OF THE INVENTION

1. Field of the Invention

The present invention relates to paper dispensers; and, more particularly, to a wrapping paper dispenser that stores one or more wrapping paper rolls and provides wrinkle free sheets having attractively cut edges.

2. Description of the Prior Art

Numerous patents disclose wrapping paper and other paper roll storage containers and cutting methods. Fancy wrapping papers such as foil based wrapping papers and polymer containing wrappers cannot be cut easily, and the cut edges of these wrappings are very oftentimes damaged, providing an unsightly appearance. Wrapping papers that have some degree of extensibility are also easily damaged owing to the propensity of these wrapping papers to deform somewhat during the cutting process.

U.S. Pat. No. 3,142,217 to Busse discloses a cutter for a dispenser of aluminum foil and like material. Specifically disclosed therein is a cutter for aluminum foil and synthetic sheet material, such as wax paper. An aluminum foil or wax sheet roll is contained in a dispensing box and is cut by the sliding movement of a cutter inclined at 45 degrees to the cutting line using a forward or reverse movement. The cutter is attached to the top cover of the dispensing box. It is held in place by an attachment portion and a handle. The cutter rides in a groove, and cuts the aluminum foil or wax paper. Due to this groove portion, the edges of the aluminum foil at the cut location are always bent downwards and wrinkled. The poor edge quality thereby produced is clearly unsuitable for wrapping paper, and this dispenser is therefore not appointed to dispense wrapping paper. The cutter is not separate from the top portion of the dispensing box. A sharp edge attached to the top portion of the box will likely cut a person's hand during loading of the roll into the dispenser.

U.S. Pat. No. 3,142,426 to Busse discloses an attachment means for a carton, to convert the same to a dispenser. The cartons are used to contain aluminum foil, waxed paper or plastic 'Saran' wrap. The severing plastic blade is attached to any dispenser that is sold. The top portion of the carton is folded to double the paper board thickness, and a slider carrying the cutting blade is snugly slid in over the double thickness paper board. A groove portion within which the cutting blade slides is slid on the upper boundary edge of the front wall of the carton. Since the blade enters a groove during the cutting operation, the edge of the aluminum foil, wax paper or plastic sheet is always curled downwards and is also wrinkled. The dispenser thus converted is therefore not well suited for precise cutting of wrapping paper.

U.S. Pat. No. 3,739,964 to Stine discloses a cutter-type box for dispensing packaging film. This cutter-type box is appointed for dispensing packaging film. It includes a separate insert for rotatably supporting a roll of the film within a rectangular box container having a closeable cover flap or panel. The film is fed outwardly through a transverse slit defined in the top cover for delivery over an edge at which a cutter is arranged. The cutter is supported, so that it projects upwardly beyond the top surface of the top cover over which the film is fed, so that the film is in a position to be cut by the cutter. The cutter is also supported below the level of the side panel edges so that it will not project outwardly from the container and thereby prone to damage during shipment. This dispenser is for cutting thin plastic sheets from a roll and includes a serrated cutter at the upper edge of the front panel of the box that contains the roll of polymeric sheet. A tearing action separates the plastic sheet with consequent deformation, which is associated with this pulling action. Delicate wrapping paper cannot sustain this pulling action, and will develop a serrated, non-smooth edge. Wrinkles covering the edges of the wrapping paper will require the edges to be re-cut using scissors.

U.S. Pat. No. 4,238,065 to Ragsdale discloses a film material dispenser. This film material dispenser is formed from paperboard, having front, back and bottom panels that are foldably connected together. A top panel, also foldably connected to the back panel, is capable of being opened or closed as desired. A slot is provided through the top panel for dispensing of the leading edge of the film material. A front flap, foldable in half, and having a cutting edge is provided at its forward-most edge. The roll of polyethylene or other sheet material is supported within the box. A sheet is fed through a slot on the top panel of the dispenser and cut using a serrated cutter on the upper edge of the front panel. This cutting action by the serrated knife requires transverse pulling of the sheet, which invariably stretches and distorts the sheet material. The cut edge is serrated and tends to tear unevenly. This cutting mechanism is unsuited for dispensing wrapping paper, since the edges are not cleanly cut with a straight edge and the stretching action results in wrinkles at the edge. These edges have to be re-cut during a second operation that involves use of scissors to produce attractive wrapping sheets.

U.S. Pat. No. 4,607,774 to Garr discloses a wrapping table assembly. The assembly comprises a table in which a roll of plastic film is mounted. The plastic film is drawn through a slot and cut by a serrated cutter as an object is being wrapped. The cutting of the plastic film involves application of force, which essentially stretches the plastic film and deforms it. The cut is created by a serrated cutter and is therefore not straight. This table top assembly is not well suited for cutting wrapping paper, since it does not produce a clean cut. The application of force to delicate wrapping paper deforms and wrinkles the wrapping paper.

U.S. Pat. No. 4,787,284 to Chen discloses a cutting apparatus for wrap film. This cutting apparatus is intended for applications involving household plastic wrap film. It comprises a sliding saddle mounted in a guiding track slot on the top of a cardboard dispenser box. Since the sliding saddle is mounted with a safety razor, the wrap film can be cut into a desired length by the safety razor when the film is pulled out of the cardboard dispenser box. The wrap film is a plastic film, and is cut by a safety razor precisely without stretching the film. The top of the cover is attached with a guiding track having end stops inserted. A slider is made to engage with the guiding track, which carries a safety razor encased within the slider. Movement of the slider results in cutting of the plastic film. This device is suited for cutting plastic films. The slider and the track are permanently attached to the top surface of the box. The plastic film has to be guided over two flanges as well as curved edges before the film can be cut. Accordingly, the slider is pushed to one side on the track, and plastic film is inserted between the slider and the guiding track and held in place while the slider is moved to affect the cut. There is no feature provided for holding the plastic film in place after insertion of the film. If the plastic film moves in any manner, the cut made is unspecific.

U.S. Pat. No. 4,796,792 to Nelson et al. discloses an apparatus for cutting wrapping paper. The wrapping paper roll is mounted below a working table and the paper is fed through a slot and retained in place. The retainer passes through the slot, and a knife member is used to cut the wrapping paper. No disclosure is contained within the '792 patent concerning a box adapted to carry the wrapping paper. A vertically oriented knife cuts the retained paper, which is under tension. This type of cutting action is not suitable for cutting wrapping paper. In view of its delicate nature, the wrapping paper would be distorted by the tension and cutting action applied.

U.S. Pat. No. 4,858,807 to Cvek discloses a trace cutter for roll material. Tracing paper sheet roll material is wound about a cylindrical shell roller. The device includes a cutting blade as long as the roller. A cutting edge of the blade is orientated away from the roller. Extending from each end of the blade is a positioning structure, which is in rolling contact with the roll of material in such a way as to maintain the blade parallel to the axis of the roll. The blade is positioned by first and second parallel arms, which are mounted for hanging from respective first and second ends of the roll by freely bearing against an inner surface of the roller. The device disclosed by the '807 patent is suitable for cutting rolled tracing paper, not wrapping paper. The roll of tracing paper is not contained within a box. The cutting knife faces away from the tracing paper and has graduation markings to determine how far the tracing paper should be cut. Accordingly, the blade forms a guide for cutting, but does not actually cut the tracing paper. Instead of being cut, the tracing paper is ripped or torn from the roll by the draftsperson.

U.S. Pat. No. 4,957,023 to Chen discloses a wrap dispenser having an automatic cutting device. A battery-operated cutting device adapted for cutting a section of thin plastic wrap off of a roll. The cut plastic sheet is commonly used to cover the top of containers with foods, fruits and vegetables. The cutting device is fixed on a mount and is slidably moved along a fixed track by a transmission mechanism activated by a battery-powered motor. A person takes hold of both corners of the outward extended thin plastic wrap and makes a smooth and continuous cut without getting the dispensed thin plastic wrap messed up. This automatic cutting device cuts plastic wraps suited for wrapping food and fruit containers. It does not cut wrapping paper. The cutting action is not manual, but rather is effected by a battery-powered motor that rides on a groove with a worm and worm gearing.

U.S. Pat. No. 5,011,059 to Jennings et al. discloses a device for holding rolls of wrapping material. Wrapping material from the plurality of rolls is cut to a selected depth when pulled from a selected roll. The device comprises a housing having a front, a back and opposite side walls. A rack between the side walls of the housing holds the rolls of wrapping material so that the rolls extend generally horizontally between the side walls. Each roll is rotatable on the rack about an axis extending longitudinally of the roll. The rack is mounted for rotation relative to the housing on a generally horizontal axis for moving a selected roll of wrapping material into a dispensing position adjacent the front of the housing. A cutter extends generally horizontally at the front of the housing for cutting a length of wrapping material pulled from a selected roll in the dispensing position. A door at the front of the housing is movable between an open position wherein wrapping material may be pulled from a respective roll and cut to length, and a closed position for concealing the rolls from view.

U.S. Pat. No. 5,044,241 to Labrecque discloses a cutting apparatus for wrap film. A housing supports a roll of paper or plastic film, while an apron supports the leading edge portion of the film. A cutting assembly is mounted over the apron and slidingly mounted along the housing to cut the leading edge. The cutting assembly includes a circular cutting wheel and a driving mechanism for rotating the wheel at a peripheral speed greater than the linear speed of the cutting assembly. The wrapping film or paper is manually pulled over an apron and the film is cut by a rotating cutter, which slides along a track. The cutter penetrates the track. Accordingly, the cutting region is not supported, and the edge of the cut paper or film is always bent. Delicate wrapping paper tends to be wrinkled by this cutting action.

U.S. Pat. No. 5,301,854 to Scobey discloses a storing and dispensing container. A roll of paper is drawn against a cutter and is torn off. This tearing action results in application of pressure to delicate wrapping paper, producing wrinkles. The cut edge is a torn edge, which is not attractive.

U.S. Pat. No. 5,611,255 to Evans discloses a food film cutter assembly. The cutter assembly cuts transparent plastic food film. The cutter rests against an anvil during cutting, and the cutter arm is manually dragged across the plastic film. This dragging action tends to distort delicate wrapping paper. A thicker wrapping paper is not readily severed by the cutter.

U.S. Pat. No. 7,000,520 to Nichols et al. discloses a roll supporting slide cutter assembly incorporating a traversable cutter tab. The assembly is supported within a carton enclosure associated with a wrap material roll. The carton enclosure is equipped with supports for a roll of aluminum foil and the like. A rail assembly is inserted to the top edge of the front face of the enclosure and a cutter assembly is inserted within the groove of the rail assembly. Traversing the cutter assembly severs the length of the packaging wrapping material. Since the cutter is an edge cutter, the packaging sheet is not supported and the cutting action will crinkle delicate wrapping paper. For these reasons, the sheet cutter disclosed by the '520 patent is not well suited for cutting wrapping paper.

U.S. patent application 2003/0209122 to Nguyen discloses a paper roll cutter. This apparatus can be employed for light, everyday hand-cutting of existing rolled material such as gift wrapping paper. The apparatus includes a frame whereon the roll of material can be positioned for rotary movement. The frame may be of fixed length to accommodate standard roll lengths or constructed to be expandable if desired. A slot is provided to allow the material to be pulled there through. A cutter blade is disposed on the frame and is adapted to slide along a path parallel with the slot to perform a clean, even cut on the material. The roll of wrapping paper is not contained within a box. The cutter assembly includes a cutter attached to a handle, which is traversed through an upper and lower track. Gift-wrapping paper must pass through the gap between the upper and lower tracks in order for the cutter to cut the paper. The cut produced is an edge cut performed on unsupported wrapping paper by a traversing blade. Such an operation tends to wrinkle delicate wrapping paper.

U.S. patent application 2004/0007606 to Baker discloses a slidable cutter for cutting sheet material. A cutter for cutting sheet materials such as plastic film or metal foil is provided. The cutter incorporates a handle, a cutting blade and a hook for attaching the cutter to a dispenser of the sheet material. The cutter rides along the top of the box to cut the sheet material. The cutter assembly is attached to the side of a box and slides along the flap using a U-shaped hook to cut the aluminum or plastic sheet. The cutter rides in the slot between the front wall and flap of the box. The slidable cutter is designed to cut aluminum foil or plastic film. Since the cutter produces an edge cut of an unsupported aluminum foil or plastic film, it exerts significant force producing wrinkles at the cut edge and thus is unsuited for cutting delicate wrapping paper.

U.S. patent application 2004/0011168 to Sears discloses paint masking. Sheet material with a single tacky surface is unrolled on a planar support and provided with a straight cut at a predetermined desired length as measured along a scale. The unrolled sheet lays wrinkle-free and is in planar contact with the planar support surface. A cutter is translated along a guide entirely across the fixed width of the sheet material, thereby producing a linear straight line cut edge parallel to the straight cut leading edge at a predetermined desired length, thereby providing an accurate, dimensionally stable, abrasion resistant, single tacky side rectangular, planar sheet mask. The mask is then adhered to glass during surface finishing of frame portions adjacent to the mask. The cutter is slidably mounted on a transverse pivotable guide rail to move away from the planar support surface sufficiently to remove the cutter as an obstruction to unrolling. In its operable position, the cutter blade extends within a linear, widthwise, slot of the planar support surface. The roll of mask material with a tacky surface is mounted on an axis, extended and cut by a cutter, which traverses within guide rails. This cutting action is edge cut by a blade on an unsupported sheet of mask material, which is said to be non-deformable. This system is unsuited for cutting delicate wrapping paper since the edge cutting action would produce wrinkles in the sheet. The roll is not contained within a container box.

U.S. patent application 2004/0216574 to Chabansky discloses a portable device for holding, sizing and cutting unrolled or flat media. The device is adapted to keep in place rolled media, while pulling the leading edge of the media, then holding the unrolled or flat media, in place. The media is typically composed of, but is not limited to, materials such as paper, plastic, metal, or fabric. A desired length of the media is measured from the leading edge. The measured portion of the media is then cut. The portable device is safe, easy, and convenient for handling, uncurling, sizing and cutting a desired portion of the media. The rolled media is placed inside a positioning section, which supports the roll. The media is unrolled and is cut by a manual cutter, which is seated inside a cutting channel. The cutter is a blade, which cuts the unsupported unrolled media edgewise, applying stress to the media. A delicate wrapping paper will produce wrinkles during this cutting operation. The device does not contain the rolled media in a dispensing box.

U.S. patent application 2005/0005755 to Turvey et al. discloses a method and apparatus for cutting a sheet material. This dispenser for sheet material includes a box and a cutting apparatus attached to the box, wherein the cutting apparatus includes a track assembly and a slider assembly disposed on the track assembly for movement therealong. The track assembly includes a base and a rail extending from an outer side of the base and terminating in a portion having an oval cross-sectional shape. The sheet being cut is a thin polymeric film, not wrapping paper. The cutter assembly, which includes a pair of tracks and an inclined cutter blade with a handle. The cutter assembly is attached to the side of the polymeric film container box. Cutting action is effected by manual movement of the cutter handle. This cutting action constitutes an edge cut of an unsupported sheet. A tendency toward deformation of the sheet makes this method of cutting not well suited for severing delicate wrapping paper wherein the cut edges wrinkle easily.

U.S. patent application 2005/0072826 to Sewell et al. discloses a gift wrap roll storage and cutting box. A rectangular open top container has a short front wall parallel to a tall rear wall and a lid that covers the open top of the container. The lid is pivotally attached to the tall rear wall of the container. When the lid is closed over the container; the lid slopes downward from the tall rear wall to the short front wall. The gift wrap roll is contained within the storage box, which has a slot on the upper surface of a lid through which the gift wrap is brought out. The serrated cutting edge is located on the front side of the lid, and the user tears the gift wrap against the serrated edge. The application of the tearing force will deform delicate wrapping paper. Moreover, the serrated cut edge does not produce a clean cut, with the result that the forces applied will likely wrinkle a delicate wrapping paper.

U.S. patent application 2006/0021485 to Richards discloses a gift wrap cutting system. This gift wrap storage and cutting system comprises a box for storing rolls of paper; and at least one cutter arranged to slide along a slide block guide parallel to an edge of the box. Each cutter comprises a blade, a blade guard, a paper guide, and a slide block that engages the slide block guide. The blade guard is spaced apart from the slide block by less than a width of a user's finger. Measurement graduation lines can be provided on the front of the container to aid in setting cutter positions. This storage box contains a plurality of gift wrap rolls. Wrapping paper is pulled out to be cut by a plurality of cutters mounted on a set of guide rods. Each cutter has a slide block support, slide block guide and blade guard, and is designed to cut the roll parallel to or perpendicular to the gift roll axis. Measurement markings are provided in the side of the container box. Each blade cuts the unsupported gift wrap paper along the edge of the blade. With this arrangement, the cut edge will wrinkle due to the force applied by the cutter, resulting in poorly cut gift wrap sheets.

Internet publication "Reynolds Slide Cutter Film" at http://www.bobthejanitor.com/rey914sc.html discloses Reynolds "slide Cutter" film 18"×2000'. This Easy Glide 18" Food Service Film has a Slide Cutter attached to the Easy-to-use dispenser carton. Convenient cutter features provide for strong clear film that clings with no snarls or tangles. The plastic film, housed in lengths of about 2,000 ft, is used for covering, storing, and wrapping. One roll is provided per case. This cutter is for cutting plastic films, not gift wraps.

Internet publication "Gift Packaging Dispensers" at http://www.nu-era.com/wrap-dispensers.asp discloses a Single Roll Wrapping Paper Dispenser. This single-roll wrapping paper dispenser is constructed of solid metal for long lasting durability and features a secure fitting, fold down clamp that holds the loose paper end in place when not in use. The fold down clamp also acts as a straight edge, creating a perfectly straight tear every time. Tearing a gift packaging sheet against a straight edge results in excessive deformation of delicate gift wraps, creating wrinkles. Moreover, the cut edge produced by this method is not smooth and attractive in appearance.

Notwithstanding the efforts of prior art workers to construct a system for dispensing wrapping paper sheets having clean, attractive, wrinkle free cut edges, there exists a need in the art for a wrapping paper storage and dispensing device that produces wrapping paper sheets having clean, wrinkle free, cut edges from conventional wrapping paper rolls as well as rolls of stretchable polymeric wrapping paper or thin, printed foil wrapping paper.

SUMMARY OF THE INVENTION

The present invention provides a wrapping paper storage and dispensing device the produces wrapping paper sheets having wrinkle free cut edges from wrapping paper rolls carrying common paper-based wrapping paper, stretchable polymer-based wrapping paper or thin, printed foil-based wrapping paper. The dispenser is a box shaped container, the sidewalls of which house one or more rolls of wrapping paper. The rolls are free to rotate, dispensing one or more wrapping paper sheets at the same time. The wrapping papers are dispensed through a paper feed slot on the top wall of the dispenser box. A flap member is associated with the dispenser box. The flap member is provided with a hinge, such as a living hinge or the like, on the upper edge of the back wall of the dispenser box. The flap member has a flap slot, which is essentially parallel to the paper feed slot, but is displaced from it by 2 to 4 inches. The wrapping paper is fed through the paper feed slot and is captured between the upper surface of the top wall of the dispenser and the hinged flap member. A separate cutter is used to cut the paper by running the knife through the flap slot, while the paper is completely supported. The support of the paper provided by the upper surface of the top wall of the dispenser box and the hinged flap member prevents curling of the wrapping paper's cut edge. Support for the wrapping paper is enhanced by providing a hard polymeric sheet removably attached to or permanently bonded with the upper top surface of the top wall of the dispenser box. In a similar manner, the flap slot in the flap member is also made from a hard polymeric sheet, providing a superior guide for the cutting knife. The cutting edge of the knife passes through the polymeric flap slot and rests on the hard polymeric sheet attached to the upper surface of the top wall of the dispenser. With the captured wrapping paper between the polymeric flap and the hard polymeric sheet, there is no deformation or stretching of the wrapping paper at or near the cutting edge. The polymeric sheet on the upper surface of the top wall of the dispenser provides low friction to the movement of the cutting knife during cutting of the wrapping paper. In addition, the polymeric sheet does not wear away, thereby facilitating the cutting of numerous sheets of wrapping papers with superior edges.

In a second embodiment, the polymeric sheet with flap slot in the hinged flap member may comprise an integral slidable knife member. The knife-edge rests on the hard polymeric sheet attached to the upper surface of the top wall of the dispenser box capturing the wrapping paper there between. Accordingly, the knife protrusion can be very minimal. This is accomplished by spring loading the knife within the slidable knife member. The spring minimizes protrusion of the knife during cutting of the wrapping paper, yet applies sufficient force to cut the wrapping paper with a clean edge.

The dispensed wrapping paper lies flat between the bottom surface of the hinged flap member and the upper surface of the top wall, and is fully supported. The upper surface of the top member is provided with a reinforcing hard polymeric sheet, which may be permanently bonded to the upper surface of the top member or inserted as a separate attachment. The hard polymeric sheet on the upper surface of the top member and the flap slot in the flap member, which is essentially parallel to the paper feed slot, is displaced from the paper feed slot by approximately 2 to 4 inches. The upper surface of the top wall directly below the flap slot is covered with a hard polymeric flat sheet. This hard flat polymeric sheet may be permanently bonded or attached to the top wall upper surface as an insert. The wrapping paper, while being supported in a flat condition by the top wall and the hinged flap member, is cut by driving a blade through the flap slot. The knife tip passes through the wrapping paper, severing it. Upon completion of the severing action, the blade comes to rest on the hard, flat polymeric surface, applying minimal drag force to the wrapping paper. Advantageously, with this cutting action, distortion or wrinkling of even very delicate wrapping paper is virtually eliminated. A hard flat polymeric surface fully supports the knife's sharp edge during the cutting operation. The knife tip does not become blunt, since the polymeric hard surface is lubricious and soft as compared to the blade hardness, and operates to prevent blade wear. When the hard flat polymeric surface shows excessive scoring, it may be replaced if the top wall is provided with this replaceable polymeric insert. The cut edge of the wrapping paper is sharp with a clean cut that is free from curling or wrinkle features and does not need any additional cutting or adjustment. The user has full control over the length of the wrapping paper needed, since it is first manually pulled out from the roll and then clamped and supported by the surfaces of the top wall and the hinged flap member. Precise control over the dimensions of each wrapping paper sheet is thereby provided.

BRIEF DESCRIPTION OF THE DRAWING

The invention will be more fully understood and further advantages will become apparent when reference is had to the following detailed description of the preferred embodiments of the invention and the accompanying drawings, in which.

DETAILED DESCRIPTION OF THE INVENTION

The present invention provides a wrapping paper dispenser that holds the wrapping paper between the top wall of a dispenser box and a hinged flap member. A cutter is run through a slot in the flap member to effect a clean cut of the wrapping paper without any stretching or deformation of the cut edges. One or more rolls of wrapping paper are secured within the dispensing box and fed through a paper feed slot. A hard polymeric sheet flap slot is provided for passing the cutter that cuts the wrapping paper. The cutter rests on a hard polymeric sheet attached to the upper surface of the top wall of the dispensing box. This hard polymeric sheet reduces the friction of the cutter, providing a smooth, high-quality cut even with polymeric soft wrapping papers or foil wrapping papers.

The first embodiment of the invention uses a separate cutter that runs through the flap slot while the wrapping paper is completely supported by the top wall member of the dispensing box and a flap member. The cutter may be a razor blade, a knife or a commonly available cutting member. The cutter rides in the hard polymeric sheet slot attached to the flap member, while the tip of the cutter glides on the hard polymeric sheet attached to the upper surface of the top wall of the dispensing box providing low friction to cutter movement. The polymeric sheets have a long service life since they exhibit high wear resistance. Typically, the polymer used is a high density polyethylene or polyolefin.

The second embodiment of the invention uses an integrated spring loaded slidable knife cutter member which rides on the flap slot. A small distance between the hard polymeric sheet of the flap member and the hard polymeric sheet of the upper surface of the top wall of the dispenser box is required for supporting the wrapping paper during the cutting operation. Therefore, the knife may not extend very much from the flap member and yet should apply adequate force on the wrapping paper to affect the cut. The knife of the cutter is attached to the slidable cutter using a compression spring. When the flap member carrying the slidable cutter is pushed against the wrapping paper, the spring is compressed with the knife applying a significant force to cut the wrapping as it moves. During this cutting operation, the wrapping paper is completely supported by the flap member and the upper surface of the top wall of the dispenser box.

Figure 1:
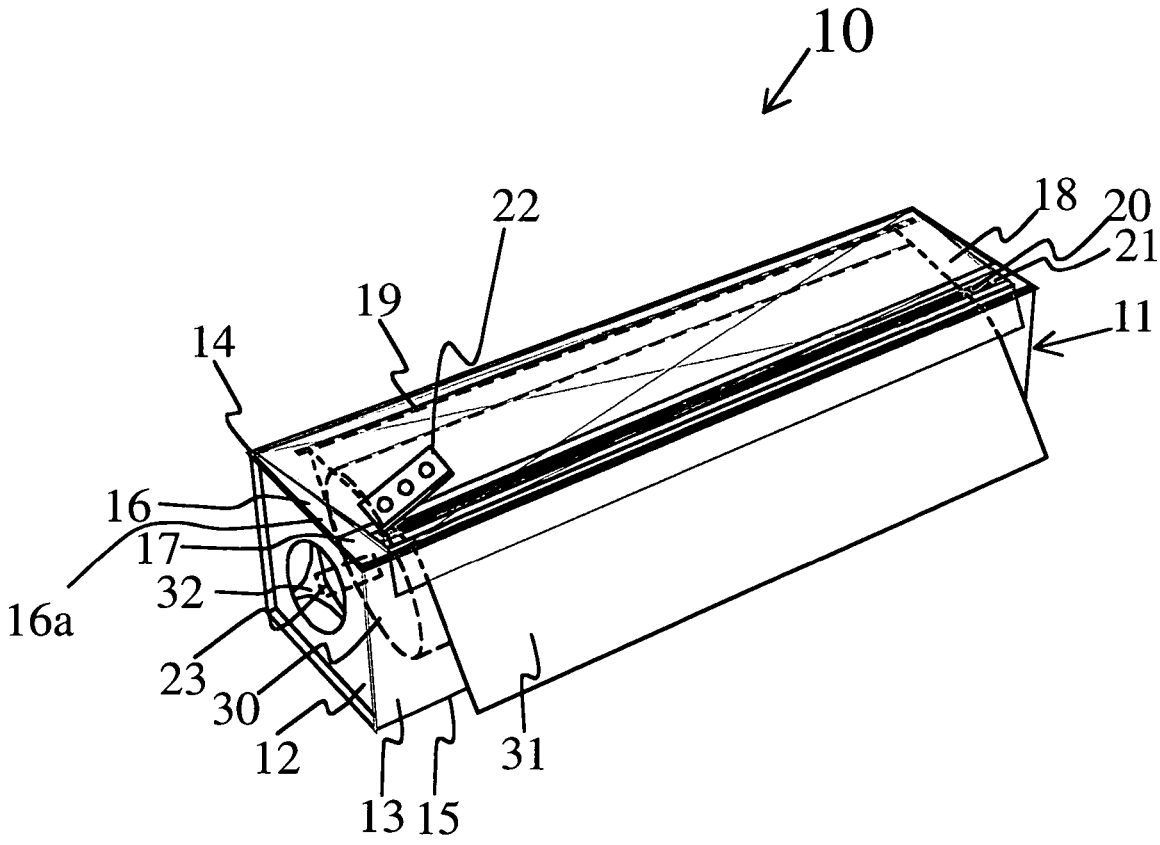
FIG. 1 is a schematic diagram of the wrapping paper storage and dispenser according to a first embodiment of the invention.

FIG. 1 illustrates the wrapping paper dispenser, showing generally at 10 a top planar view thereof. The Wrapping Paper Dispenser 10 comprises a container 11 generally having a substantially rectangular shape. Container 11 is adapted to receive one or more conventionally sized rolls of wrapping paper. This figure shows a single roll of wrapping paper being inserted into the dispenser 10. Container 11 includes a front wall 13, back wall 14, bottom wall 15, top 16, and side walls 12 arranged to form an interior compartment adapted to receive a roll of wrapping paper 30 for storage and dispensing thereof. Front wall 13 is, optionally, provided with an opening (not shown) through which the user may discern the color, pattern and like characteristics of wrapping paper housed within container 11. The roll of wrapping paper 30 comprises wrapping paper 31 rolled thereon, and includes end supports 32, one on each side, which abut side walls 12 of container 11. Top 16 of container 11 has an opening aperture therein, so that when top 16 opens, a roll of wrapping paper 30 can be inserted into the interior compartment of container 11. The upper surface of the top wall 16 of the dispenser container 11 comprises a hard flat polymeric sheet 16a having a hard polymeric strip 17 removably or permanenfly attached as shown. Front wall 13 of container 11 comprises a closure flap 18, which closes container 11. This closure flap 18 is hinged on the top edge of the back wall 14. Top 15 of container 11 comprises a paper feed slot 19 through which the wrapping paper is delivered to the space between the closure flap 18 and the upper surface of the top wall 16 of the dispenser box 11. The flap portion 18 has a flap slot 20 in a hard polymeric sheet 21 that may be removably or permanently attached to the closure flap 18. The flap slot 20 is essentially parallel to the paper feed slot 19, but is displaced from it. The wrapping paper 31 is thus held flat and fully supported between the upper surface or hard flat polymeric sheet 16*a* of the top wall 16 and the bottom surface of the closure flap / flap member 18. A cutter 22 is used to score the flat, fully supported paper, creating a clean cut. The cutter contacts the hard polymeric strip 17 on the upper surface of the top wall 16 of the dispenser box and rides in the slot 20 in the hard polymeric sheet 21 attached to the flap member 18. The cutter 22 glides freely in the slot 20 with minimal drag. The wrapping paper is thereby cut with virtually no distortion or wrinkle formation. The Wrapping Paper Dispenser may further comprise a rod 23, which is removably inserted in the roll of wrapping paper 30, and removably received by a securing means, disposed within the interior compartment of container 11.

Figure 2:
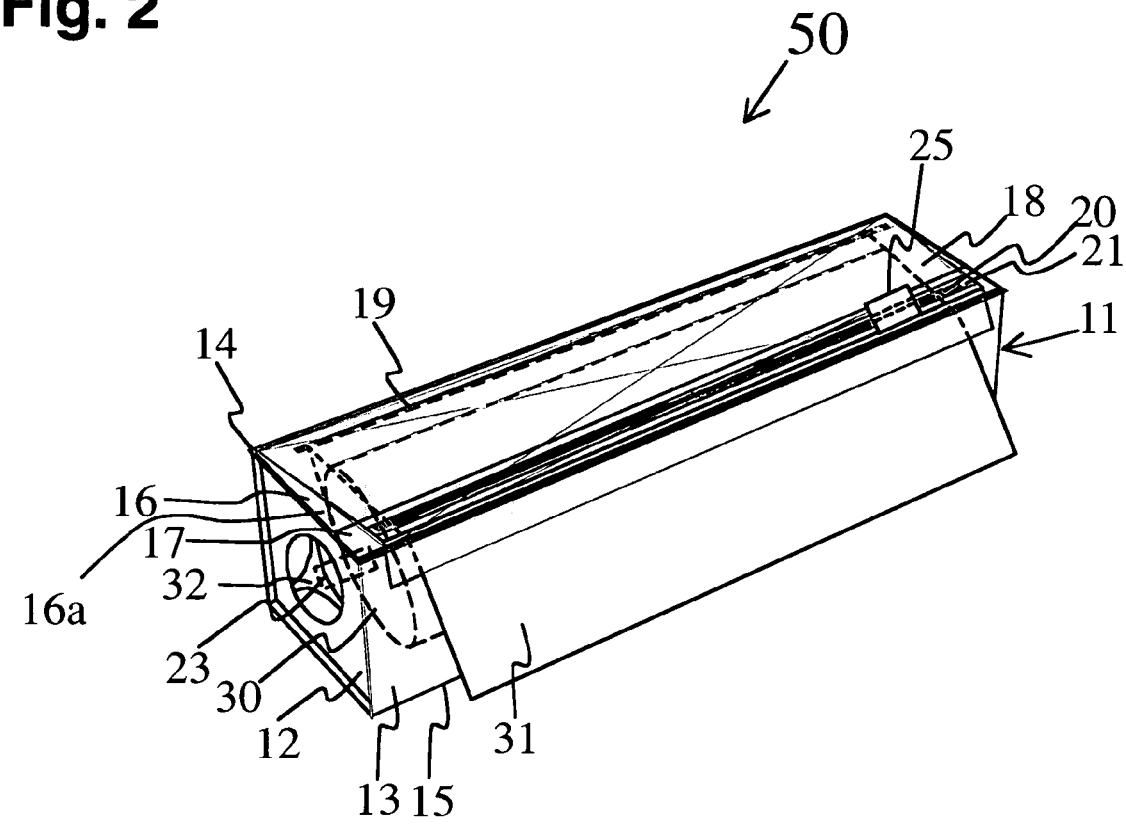
FIG. 2 is a schematic diagram of the wrapping paper storage and dispenser according to a second embodiment of the invention.

FIG. 2 illustrates the second embodiment of the wrapping paper dispenser, showing generally at 50 a top planer view thereof. The freestanding cutter 22 is replaced by a sliding cutter 25 which rides on the slot 20, cuffing the wrapping paper 31. An identical numbering system is used for all common parts of the Wrapping Paper Dispenser 10. Due to the closed special relationship between the hard polymeric sheet 21 with flap slot 20 and the hard flat polymeric sheet 16*a* with hard polymeric strip 17 supporting the wrapping paper, the knife edge of the sliding cutter 25 can only minimally protrude.

Figure 3:
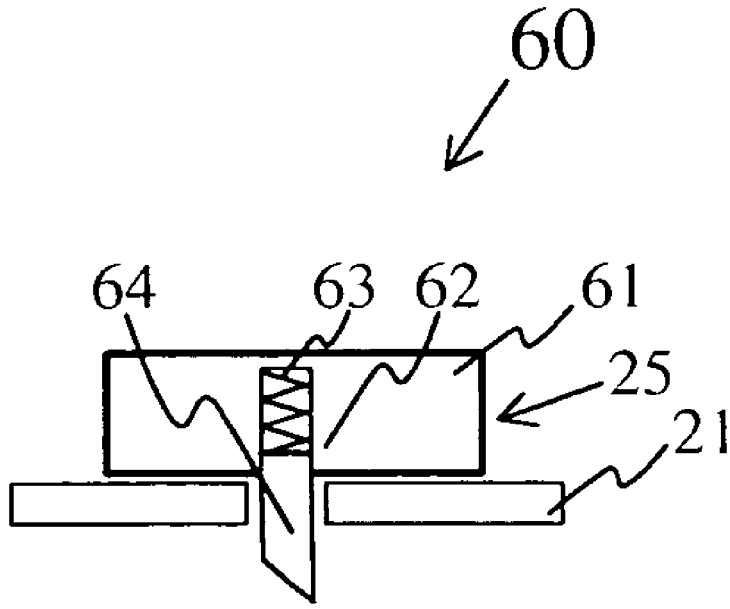
FIG. 3 is a schematic diagram of the spring loaded slidable cutter according to the second embodiment of the invention.

FIG. 3 illustrates the details of the sliding cutter 25 at 60. 21 is the hard polymeric sheet with a slot 20 in which the cutter 25 rides. The cutter 25 has a handle member 61 with a borehole 62 for receiving a compression spring 63. A cutter 64 rests on the spring and can be displaced vertically, thereby cutting the wrapping paper. An optional stop (not shown in the figure) may be provided on the cutter 64 to prevent it from dislodging from the borehole 62.

Figure 4:
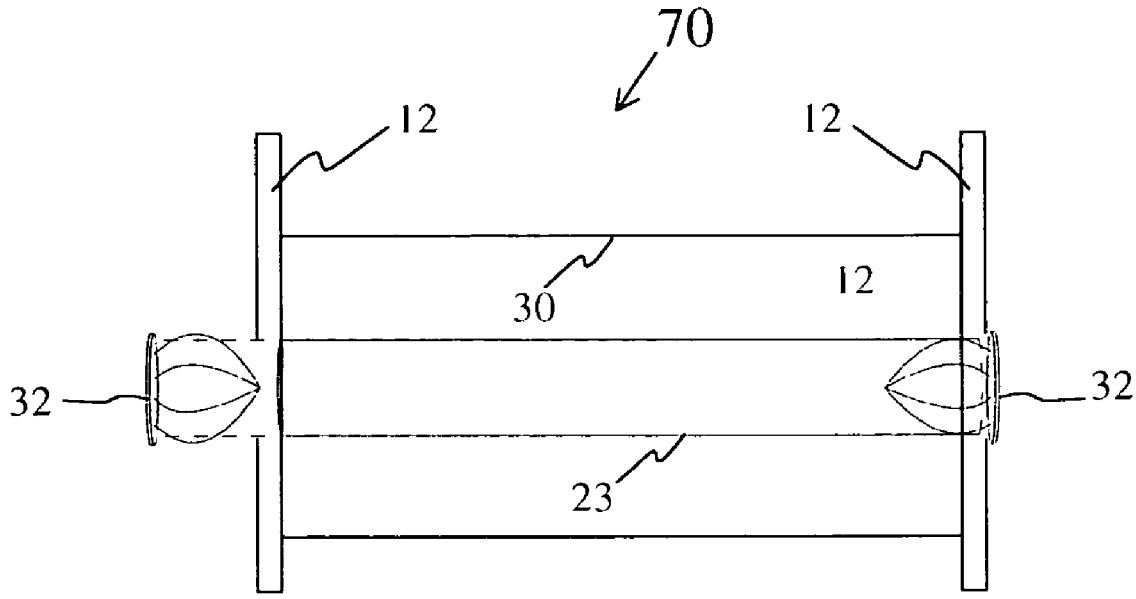
FIG. 4 is a schematic diagram of the attachment of a wrapping paper roll to the side walls of the dispenser box.

FIG. 4 illustrates the attachment of the wrapping paper roll 30 to the interior of the dispenser box. The wrapping paper roll 30 is slid over a attachment rod 23 which is held in place by two retainers 32 that secure the rod to the side walls 12 of the dispenser box. When more than one roll of wrapping paper is inserted into the dispenser box they are attached in a similar manner.

The Wrapping Paper Dispenser of the present invention is especially suited for use in wrinkle free cutting of even delicate wrapping paper. Cut edges provided by the Wrapping Paper Dispenser are free from cutting defects and wrinkles. Generally stated, the Wrapping Paper Dispenser comprises, in combination, the features set forth below:

1) a Wrapping Paper Dispenser having a container with a back wall, two side walls, a front wall and a top wall, the back wall having a top flap member hinged at the top edge thereof;
2) the side walls being provided with retaining means to accept one or more rolls of wrapping paper;
3) the top wall having a paper feed slot to withdraw and guide and support the wrapping paper between the top wall and the hinged flap member;
4) the hinged flap member having a flap slot in a hard polymeric attachment;
5) the flap slot being displaced from the top wall paper feed slot;
6) the upper surface of the top wall being provided with a hard flat polymeric surface directly below the flap slot; and
7) the wrapping paper being clamped and supported in a flat condition between the top wall and the hinged flap member, and being cut by a separate cutter or a spring loaded integral cutter that passes through the flap slot and rests on the hard flat polymeric surface on the upper surface of the top wall of the dispenser;

whereby the fully supported flat sheet of wrapping paper between the top wall and the hinged member is cut in a straight line by a separate blade or a slidable integral spring loaded cutter so as to exert minimal forces and thereby minimize wrinkle formation even when the sheet comprises a very delicate wrapping paper.

Having thus described the invention in rather full detail, it will be understood that such detail need not be strictly adhered to, but that additional changes and modifications may suggest themselves to one skilled in the art, all falling within the scope of the invention as defined by the subjoined claims

What is claimed is:

1. A wrapping paper storage device and dispenser, comprising:

a. a wrapping paper dispenser box comprising a container with a back wall, front wall, two side walls, a top wall and a bottom wall, and a flap member hinged at a top edge of said back wall;

b. said side walls being provided with a retainer means for accepting one or more wrapping paper rolls;

c. said top wall of said container having a paper feed slot for withdrawing and guiding wrapping paper from said one or more rolls between said top wall of said dispenser box and said hinged flap member;

d. said hinged flap member having a removable or permanently bonded hard polymeric flap slot that is displaced from said paper feed slot;

e. said top wall having an upper surface comprising a hard flat polymeric sheet that is directly below said flap slot;

f. said wrapping paper being clamped and supported by said hard polymeric sheet of said top wall and said hard polymeric flap slot; and g. said wrapping paper being severed by a cutter while said wrapping paper is completely supported, whereby the fully supported wrapping paper is severed by said cutter without wrinkles or deformations.

2. The wrapping paper storage device and dispenser as recited by claim 1, wherein said side walls are provided with retainer means to support one roll of wrapping paper.

3. The wrapping paper storage device and dispenser as recited by claim 1, wherein said wrapping paper retaining means includes a central rod and two end supports.

4. The wrapping paper storage device and dispenser as recited by claim 1, wherein said hard flat polymeric sheet comprising said upper surface of said top wall is a high density polyethylene sheet.

5. The wrapping paper storage device and dispenser as recited by claim 1, wherein said hard flat polymeric sheet comprising said upper surface of top wall is a polyolefin sheet.

6. The wrapping paper storage device and dispenser as recited by claim 1, wherein said hard flat polymeric sheet comprising said flap slot is a high density polyethylene sheet.

7. The wrapping paper storage device and dispenser as recited by claim 1, wherein said hard flat polymeric sheet comprising said flap slot is a polyolefin sheet.

8. The wrapping paper storage device and dispenser as recited by claim 1, wherein said cutter is a separate knife cutter that slides in said flap slot contacting said hard polymeric sheet at said upper surface of said top wall of said dispenser box.

9. The wrapping paper storage device and dispenser as recited by claim 1, wherein said cutter is an integrated, slidable, spring-loaded knife cutter that slides in said flap slot contacting said hard polymeric sheet at said upper surface of said top wall of said dispenser box.

10. The wrapping paper storage device and dispenser as recited by claim 9, wherein said cutter contacts a compression spring in a borehole in said integrated slidable spring loaded knife cutter.

11. The wrapping paper storage device and dispenser as recited by claim 10, wherein said cutter is provided with a stop to prevent dislodgement from said borehole.

* * * * *